United States Patent [19]

Suzuki et al.

[11] Patent Number: 4,818,605

[45] Date of Patent: Apr. 4, 1989

[54] THERMOSENSITIVE IMAGE TRANSFER RECORDING MEDIUM

[75] Inventors: Akira Suzuki, Mishima; Nobuo Mochizuki, Kannami; Motoo Tasaka, Susono; Kunichika Morohoshi, Numazu, all of Japan

[73] Assignee: Ricoh Company, Ltd., Tokyo, Japan

[21] Appl. No.: 38,645

[22] Filed: Apr. 15, 1987

[30] Foreign Application Priority Data

| | | | |
|---|---|---|---|
| Apr. 18, 1986 | [JP] | Japan | 61-88204 |
| Aug. 29, 1986 | [JP] | Japan | 61-201856 |
| Sep. 4, 1986 | [JP] | Japan | 61-206844 |

[51] Int. Cl.[4] ..... B41M 5/26

[52] U.S. Cl. ..... 428/321.3; 428/203; 428/207; 428/208; 428/211; 428/488.1; 428/488.4; 428/499; 428/532; 428/533; 428/535; 428/913; 428/914

[58] Field of Search ..... 428/203, 207, 208, 211, 428/242, 244, 321.3, 913, 914, 488.1, 488.4, 499, 532, 533, 535

[56] References Cited

U.S. PATENT DOCUMENTS

| | | | |
|---|---|---|---|
| 4,612,243 | 9/1986 | Shimazaki | 428/321.3 |
| 4,624,891 | 11/1986 | Sato et al. | 428/321.3 |

FOREIGN PATENT DOCUMENTS

| | | | |
|---|---|---|---|
| 0105579 | 8/1980 | Japan | 428/421.3 |
| 0188690 | 11/1983 | Japan | 428/421.3 |

*Primary Examiner*—Ellis P. Robinson
*Assistant Examiner*—P. R. Schwartz
*Attorney, Agent, or Firm*—Oblon, Fisher, Spivak, McClelland & Maier

[57] ABSTRACT

A thermosensitive image transfer recording medium comprising a support material; an image transfer layer formed on the support material, comprising a fine porous network structure made of a resin comprising cellulose acetate butyrate; a non-volatile oily material which is contained in the fine porous network structure, and which does not dissolve the resin of the fine porous network structure; and a thermofusible ink composition which is held in the fine porous network structure, comprising (a) a thermofusible wax material is solid at room temperature, and (b) a colorant.

16 Claims, 3 Drawing Sheets

THERMOSENSITIVE IMAGE TRANSFER RECORDING MEDIUM

BACKGROUND OF THE INVENTION

The present invention relates to a thermosensitive image transfer recording medium capable of forming on a receiving sheet images having high image density, excellent image gradation and durability, with high thermal sensitivity by application of heat to an image transfer layer of the recording medium, for instance, through a thermal head or a laser beam application device so as to imagewise transfer a thermofusible ink composition contained in the image transfer layer to the receiving sheet, thereby recording images on the receiving sheet. The thermofusible ink composition comprises as the main components a colorant and a thermofusible wax material.

More particularly, the present invention relates to a thermosensitive image transfer recording medium comprising a support material and an image transfer layer formed thereon, which image transfer layer comprises (i) a fine porous network structure made of a resin comprising a cellulose acetate butyrate, (ii) a non-volatile oily material which is contained in the fine porous network structure, and which does not dissolve the resin of the porous network structure, and (iii) a thermofusible ink composition held in the porous network structure, which comprises as the main components a colorant, and a thermofusible wax material which is solid at room temperature.

Conventionally, there are known (i) a thermosensitive image transfer sheet comprising a support material and a sublimable dye layer formed on the support material, and (ii) a thermosensitive image transfer sheet comprising a support material and a thermofusible ink layer comprising a thermofusible material and a pigment which are homogeneously dispersed therein, capable of forming images on a receiving sheet by subjecting the thermosensitive image transfer medium to thermal printing.

The method using a sublimable dye, however, is superior in the reproduction of image gradation, but has the drawbacks that the thermal sensitivity is low and the durability of the reproduced image is poor. On the other hand, the method using a thermofusible material and a pigment is superior in thermal sensitivity and the durability of the produced images, but has the drawback that the image gradation is unsatisfactory.

Furthermore, there has been proposed a thermosensitive image transfer recording medium comprising a support material and a fine porous structure formed thereon, which contains a thermofusible ink composition consisting essentially of (a) a thermofusible material which is solid at room temperature and (b) a colorant. In comparison with the conventional thermofusible type recording mediums, the above proposed thermosensitive image transfer recording medium is improved on image gradation, but the image gradation obtained by this recording medium is not as good as that obtained by the recording medium using a sublimable dye.

Further, in the case of the above thermosensitive image transfer medium, when image transfer is performed onto a receiving sheet having high smoothness such as a receiving sheet made of synthetic paper or high quality paper, high image density and precise image gradation can be obtained. However, when image transfer is performed onto a receiving sheet having a rough surface, for instance, having a smoothness of 100 seconds or less, clear images cannot be obtained due to the rough surface of the receiving sheet, with the formation of non-uniform solid images and poor image gradation.

SUMMARY OF THE INVENTION

It is therefore an object of the present invention to provide a thermosensitive image transfer recording medium from which the above mentioned shortcomings of the conventional recording mediums have been eliminated, and which is superior in image producing stability and thermal sensitivity and capable of yielding images with high image density and excellent image gradation, even on a receiving sheet having a rough surface.

The above object of the present invention is attained by a thermosensitive image transfer recording medium comprising a support material and an image transfer layer formed thereon, which image transfer layer comprises (i) a fine porous network structure made of a resin comprising a cellulose acetate butyrate, (ii) a non-volatile oily material which is contained in the fine porous network structure, and which does not dissolve the resin of the porous structure, and (iii) a thermofusible ink composition held in the porous network structure. The thermofusible ink composition comprises as the main components a colorant, and a thermofusible wax material which is solid at room temperature.

In order to attain smooth image transfer with high image density and precise image gradation onto a receiving sheet having a rough surface, for instance, having a smoothness of 100 seconds or less, it is preferable that the content of the non-volatile oily material in the image transfer layer be in the range of about 20 to 50 wt. %, and the viscosity of the non-volatile oily material be 300 cps or less at 25° C.

In particular, in order to improve the image gradation, an image gradation control agent can be contained in the image transfer layer.

Further, in order to improve the image producing stability, a protective layer can be formed on the back side of the support material opposite to the image transfer layer, which protective layer not only protects the support material from the heat applied thereto through a thermal head during the course of thermal printing, but also facilitates smooth running of the thermal head on the support material.

DETAILED DESCRIPTION OF THE PREFERRED EMBODIMENTS

Figure 1:
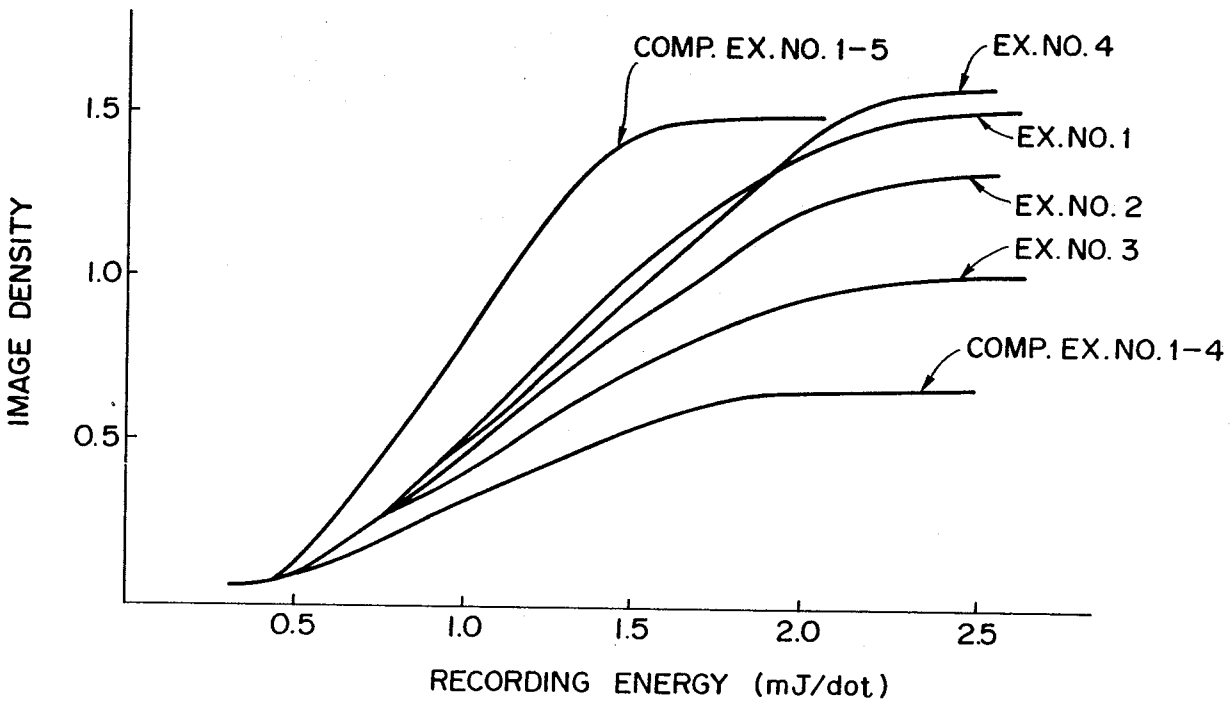
FIGS. 1 through 3 are graphs showing the relationship between the image density and the thermal energy or recording energy applied per dot in examples of a thermosensitive image transfer recording medium according to the present invention and in comparative thermosensitive image transfer recording mediums, by which their respective image gradations are indicated.

In the thermosensitive image transfer medium comprising a support material and an image transfer layer according to the present invention, it is considered that when heat is applied to the image transfer layer for image formation by means of a thermal head or the like, the thermofusible ink composition or the colorant gradually seeps from the fine pores of the network structure and is then transferred to a receiving sheet.

The amount of the thermofusible ink composition or the colorant which seeps out varies in accordance with the amount of thermal energy applied to the image transfer layer. Therefore, the amount of the thermofusible ink composition or the colorant transferred can be accurately controlled by controlling the amount of thermal energy applied. Accordingly image reproduction with wide-range gradation can be attained, so that a clear image faithful to the original image can be reproduced.

The amount of thermal energy to be applied of course varies, depending upon the specific materials employed in the thermosensitive image transfer recording medium and the thickness of the thermofusible image transfer layer.

Preparation of Image Transfer Layer

In the present invention, the image transfer layer can be prepared, for example, by the following method.

A thermofusible wax material, a non-volatile oily material, and a colorant are mixed and dispersed in a suitable organic solvent using a dispersing device such as an attritor or a ball mill to obtain a thermofusible ink composition.

It is considered that the non-volatile oily material employed above has at least two functions of (i) facilitating the smooth and uniform transfer of the thermofusible ink composition onto a receiving sheet having a rough surface by decreasing the viscosity of the thermofusible ink composition at the time of image transfer, particularly when the oily material is used in an amount of about 20 to 50 wt. % in the image transfer layer, and (ii) serving as an auxiliary agent for forming fine pores in the network structure made of the resin. To more facilitate the transfer of the thermofusible ink composition, it is preferable to employ a non-volatile oily material having a viscosity of 300 cps or less at 25° C. in the above-mentioned amount.

A resin comprising a cellulose acetate butyrate for forming the porous network structure is separately dissolved in an organic solvent or a mixed solvent such as methyl ethyl ketone and toluene to prepare a solution of the resin.

This solution is mixed with the previously obtained ink dispersion. The mixture is then uniformly dispersed using a blender such as a ball mill. The thus obtained dispersion is then applied to a support material and dried, so that an image transfer layer, comprising a fine porous network structure made of the resin in which the thermofusible ink composition is held, is formed on the support material.

A dispersing agent such as a non-ionic surfactant may be added to the above dispersion to facilitate the dispersion of the thermofusible wax material, the colorant and the oily material A commercially available example of the dispersing agent is Sorbon T-80, which is a non-ionic surfactant, sorbitan monoleate, made by Toho Chemical Industry Co., Ltd.

In addition, commonly used humectants and fillers may be added, as required, to the above dispersion.

An alternative method by which the image transfer layer is formed comprises the steps of kneading a material, which is not compatible with the resin for the fine porous network structure, but soluble in a solvent which will not dissolve the resin, together with the resin, applying the kneaded mixture to the surface of a support material to form a resin layer, dissolving the first mentioned material in the solvent to leave the fine porous resin structure on the support material, and filling the previously mentioned ink composition into the porous network structure, whereby an image transfer layer having the same structure as that of the first mentioned image transfer layer.

Resins for Fine Porous Network Structure

In the present invention, as a resin for forming porous network structure, a resin comprising a cellulose acetate butyrate is employed which is a mixed ester of cellulose containing acetyl groups and butyryl groups. The cellulose acetate butyrate can also be employed alone.

Commercially available cellulose acetate butyrates can be classified into the following three types depending upon the content of butyryl group:

(1) Low Butyryl Content Type (16 to 17%), m.p. 210° C. or more (2) Medium Butyryl Content Type (27 to 38%), m.p. 155 to 210° C.

(3) High Butyryl Content Type (50%), m.p. 110° to 160° C.

As can be seen from the above, the higher the content of butyryl group, the lower the melting point. In other words, the lower the content of butyryl group, the higher the melting point.

Therefore, in the present invention, it is preferable to use the cellulose acetate butyrates of the medium and low butyryl group content types in view of the necessity for the heat resistance of the porous network structure. In other words, cellulose acetate butyrates having a butyryl content of 38% or less are preferable for use in the present invention. As a matter of course, the cellulose acetate butyrate of the low butyryl group content type is most preferable for use in the present invention.

Non-volatile Oily Materials

As the non-volatile oily material for use in the present invention, the following can be employed:

Vegetable oils and animal oils such as cotton oil, rape oil and whale oil, mineral oils such as motor oil, spindle oil and dynamo oil.

Further, as such oily material, lanolin fatty acid oil, lanolin fatty acid metal salt oil such as lanolin fatty acid calcium salt oil, and lanolin fatty acid ester oil can also be employed. Specific examples of such oils are Neocoat OES-181, OES-183, LFC-50M and LS-3102MB (made by Yoshikawa Oil & Fat Co., Ltd.).

Further, it is preferable that the oily material for use in the present invention have a viscosity of 300 cps or less at 25° C. for attaining more uniform and more smooth image transfer onto a receiving sheet having a rough surface.

This phenomenon can be explained by using the following Olson-Peel's Formula concerning the osmosis of liquid into a paper including numerous capillaries under application of an external pressure to the paper. This formula indicates the permeating depth d of the liquid into the paper at the moment an external pressure is applied thereto:

$$d = \sqrt{Pr^2t/4\eta}$$

where P represents the external pressure, r represents the diameter of each capillary in the paper, t represents time, and $\eta$ represents the viscosity of the liquid. The above formula indicates that when P, r and t are constant, the permeating depth d, of the liquid, that is, the amount of the transferred liquid into the paper, increases as the viscosity $\theta$ of the liquid decreases.

Specific examples of a non-volatile oily material having a viscosity of 300 cps or less at 25? C. for use in the present invention are as follows, which are made by Itoh Oil Manufacturing Co., Ltd:

(1) Esters derived from high alcohols and the following fatty acids:

| Trademark | Fatty Acids | Viscosity (cps/25° C.) |
|---|---|---|
| HISORATE = 4 | Ricinoleic Acid | 53.6 |
| HISORATE = 5 | Isocaprylic Acid | 8.8 |
| HISORATE = 7 | "Versatic" Acid | 12.7 |
| HISORATE = 10 | Isostearic Acid | 24.3 |
| HISORATE = 11 | Stearic Acid | 20.0 |
| HISORATE = 22 | 12-hydroxystearic Acid | 51.4 |
| HISORATE = 101 | Capric Acid | 22.2 |
| HISORATE = 105 | Isocaprylic Acid | 24.2 |
| HISORATE = 107 | "Versatic" Acid | 36.8 |
| HISORATE = 108 | "Dimer Acid" | 36.0 |
| HISORATE = 110 | Isostearic Acid | 56.0 |
| HISORATE = 111 | Stearic Acid | 36.8 |
| HISORATE = 117 | Oleic Acid | 80 |
| HISORATE = 122 | 12-hydroxystearic Acid | Paste |

(2) Hydroxy Fatty acid Esters

| Trademark | Composition | Viscosity (cps/25° C.) |
|---|---|---|
| CO-FA Methyl | Methyl Ricinolate | 40 |
| CO-FA Methyl-D | Methyl Ricinolate (distilled) | 30 |
| CO-FA Ethyl-D | Ethyl Ricinolate (distilled) | 30 |
| CO-FA Butyl | Butyl Ricinolate | 40 |
| MAR | Methylacetyl Ricinolate | 13 |
| BAR | Butylacetyl Ricinolate | 17 |

(3) Others

| Material | Viscosity (cps/25° C.) |
|---|---|
| Soybean Oil | 120 |
| Peanut Oil | 150 |
| Liquid Paraffin | 250 |

The above oily materials contain volatile components (at 120° C.) in an amount of 1.0 wt. % or less. The esters derived from higher alcohols given in (1) are most preferable for use in the present invention in view of the use of the thermosensitve image transfer recording medium over an extended period of time.

Thermofusible Wax Materials

The thermofusible wax materials for use in the present invention are as follows:

(1) Animal Waxes

As the animal wax for use in the present invention, a lanolin derivative wax can be employed.

Examples of a lanolin derivative wax are reduced lanolin, hard lanolin, lanolin alcohol, hydrogenated lanolin alcohol, lanolin fatty acid, metal salts of lanolin fatty acid, esters of lanolin fatty acid, and mixtures thereof. These waxes are solid at room temperature and become liquid when heated above their respective melting points. Of the above lanolin derivative waxes, lanolin fatty acid, metal salts of lanolin fatty acid, esters of lanolin fatty acid and mixtures thereof are particularly preferable for use in the present invention.

It is preferable that lanolin fatty acid for use in the present invention comprise a hydroxylated fatty acid, an iso-fatty acid, and an anti-iso-fatty acid, each having 13 to 33 carbon atoms.

As the metal salts of the lanolin fatty acid, for example, sodium salt, potassium salt, calcium salt, magnesium salt, barium salt, zinc salt, lead salt, manganese salt, iron salt, nickel salt, cobalt salt and aluminum salt can be employed.

Further as the esters of lanolin fatty acid, for example, esters of methyl alcohol, ethyl alcohol, butyl alcohol, glycerin, pentaerythritol, polypropylene glycol and trimethylolpropane can be employed. These esters can be employed alone or in combination with the above-mentioned metal salts.

Commercially available waxes containing the above metal salts of lanolin fatty acid are LANOX HHY-50, LANOX HH-73, and LANOX HHC-82 (made by Yoshikawa Oil & Fat Co., Ltd.).

(2) Mineral Waxes

As the mineral wax for use in the present invention, montan wax can be employed, which is derived by extraction of lignite or by purification of a crude product obtained by the above extraction.

Of the above waxes, waxes having a melting point in the range of 60° C. to 100° C. are preferable for use.

Instead of the above natural waxes, synthetic waxes such as polyethylene wax and polyester-based wax can be employed.

The lanolin derivative wax and montan wax may be used in combination with a conventionally employed thermofusible material, with a mixing ratio by weight of the wax to the thermofusible material being 1 : not more than 1.

Examples of such thermofusible material are waxes such as carnauba wax, paraffin wax, microcrystalline wax and castor wax; higher fatty acids, metal salts and esters of higher fatty acids such as stearic acid, palmitic acid, lauric acid, aluminum stearate, lead stearate, barium stearate, zinc stearate, zinc palmitate, methylhydroxy stearate, glycerol monohydroxy stearate; homopolymers and copolymers such as polyethylene, polypropylene, polyisobutylene, polyethylene wax, polyethylene oxide, polytetrafluoroethylene, ethylene—acrylic acid copolymer, ethylene—ethyl acrylate copolymer, ethylene—vinyl acetate copolymer. These thermofusible materials can be employed either alone or in combination when mixed with the lanolin derivative wax or montan wax.

It is preferable that the lanolin derivative wax, montan wax or the above mentioned mixture be employed in an amount of 50 to 200 parts by weight to 100 parts by weight of the resin which constitutes the fine porous network structure.

Colorants

As the colorant for use in the present invention, the following dyes and pigments are preferably employed for obtaining images with excellent image gradation:

Examples of such dyes are direct dyes, acid dyes, basic dyes, mordant dyes, sulfur dyes, building dyes, azoic dyes, oil dyes and thermosublimable disperse dyes.

Specific examples of the above dyes are as follows:

(1) Direct Dyes:
Direct Sky Blue and Direct Black W
(2) Acid Dyes:
Tartrazine, Acid Violet 6B and Acid Fast Red 3G
(3) Basic Dyes:
Safranine, Auramine, Crystal Violet, Methylene Blue, Rhodamine B and Victoria Blue B.
(4) Mordant Dyes:
Sunchromine Fast Blue MB, Eriochrome Azurol B and Alizarin Yellow
(5) Sulfur Dyes:
Sulphur Brilliant Green 4G
(6) Building Dyes:
Indanthrene Blue
(7) Azoic Dyes:
Naphthol AS
(8) Oil Dyes:
Nigrosin, Spirit Black EB, Varifast Orange 3206, Oil Black 215, Butter Yellow, Sudan Blue II, Oil Red B and Rhodamine B
(9) Disperse Dyes:
(9-1) Monoazo Disperse Dyes: Disperse Fast Yellow G, Disperse Fast Yellow 5G, Disperse Fast Yellow 5R and Disperse Fast Red R;
(9-2) Anthraquinone Disperse Dyes: Disperse Fast Violet OR, Disperse Fast Violet B, Disperse Blue Extra and Disperse Fast Brilliant Blue B; and
(9-3) Nitrodiphenylamine Disperse Dyes: Disperse Fast Yellow RR and Disperse Fast Yellow GL In addition to the above dyes, the following commercially available colorants can be employed in the present invention: Neoazpon Red 346, Neozapon Blue 807, Neozapon Yellow 157, Kayaset Black, Spilon Blue 2BNH, Spilon Red GRLT, Spilon Red GRLT Special, Sudan Red 460, Sudan Blue 670, and Sudan Yellow 150.

Further in the present invention, a finely-divided pigment can also be employed as the colorant. As such a finely-divided pigment, it is preferable that the particle size be not more than 1.0 μm, more preferably not more than 0.5 μm, after sufficient dispersion.

Specific examples of such finely-divided pigments are the following pigments which are commercially available from Hoechst:

Permanent Yellow GG 02 (C.I. Pigment Yellow 17),
Permanent Yellow DHG trans 02 (C.I. Pigment Yellow 12),
Novoperm Yellow HR 03 (C.I. Pigment Yellow 83),
Hansa Brilliant Yellow 5GX 02 (C.I. Pigment Yellow 74),
Permanent Orange RL 01 (C.I. Pigment Orange 34),
Novoperm Red HFG (C.I. Pigment Orange 38),
Novoperm Red HFT (C.I. Pigment Red 175),
Permanent Lake Red LCLL 02 (C.I. Pigment Red 53:1),
Novoperm Red HF 4B (C.I. Pigment Red 187),
Permanent Carmine FBB02 (C.I. Pigment Red 146),
Permanent Rubine L 6B (C.I. Pigment Red 57:1),
Hostaperm Pink E trans (C.I. Pigment Red 122), and
Reflex Blue R50 (C.I. Pigment Blue 61).

In addition to the above, carbon black can be employed.

Further, in the present invention, the following monoazo pigments having the following general formula can also be used as colorant:

X-N=N-Y where X represents a diazonium salt moiety and Y represents a coupler moiety.

(1) Sico Fast Yellow D 1355 (made by BASF)
(2) Sico Fast Yellow D 1250 (made by BASF)
(3) Lake Red LC (made by Hoechst) having the formula:

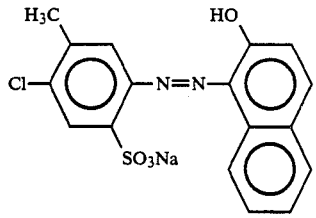

(4) Lake Red C 405 (made by Dainichi Seika Color and Chemicals Mfg. Co., Ltd.)
(5) Fast Red 1547 (made by Dainichi Seika Color and Chemicals Mfg. Co., Ltd.) having the formula:

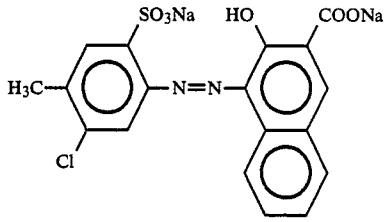

It is preferable that these colorants be in a dissolved or finely dispersed state in the thermosensitive ink composition. When the previously mentioned dyes are used in combination with the above pigments, it is preferable that the colors of the pigments be the same as or similar to the colors of the dyes.

Image Gradation Control Agents

In the present invention, an image gradation control agent can also be added to the image transfer layer in order to improve the image gradation of the images to be obtained.

The image gradation control agent for use in the present invention is more wetting and more compatible with the resin for the fine porous network structure than with the main components of the thermofusible ink composition such as the thermofusible wax material and is firmly held within the fine porous network structure and functions to precisely control the amount of the thermofusible ink composition transferred from the image transfer layer. It is considered that the image gradation control agent is able to precisely control the surface pore diameter of the fine porous network structure so as to make the pore diameter small, and when thermal energy is applied to the image gradation control agent, the image gradation control agent remains in the fine porous network structure, without being transported outside the porous network structure, thereby controlling the amount of the thermofusible ink composition transferred from the image transfer layer. Therefore, as such image gradation control agents, any materials can be employed as long as they work in the above-described manner. Specific examples of such image gradation control agents may be, but not restricted to, the following:

(a) Needle-like Pigments

As such needle-like pigments, not only inorganic pigments, but also organic pigments can be employed as long as they are in the form of needle and can constitute a network in the image transfer layer.

Specific ex:unples of such needle pigments are ochre, Chrome Yellow G, Phthalocyanine pigments such as Phthalocyanine Blue, Lithol Red, BON Maroon Light, terra abla, needle zinc oxide, 2,7-bis[2-hydroxy-3-(2-chlorophenylcarbamoyl)naphthalene-1-ylazo]-9-fluorenone, 4',4''-bis [2-hydroxy-3-(2,4-dimethylphenyl)carbamoylnaphthalene-1-ylazo]-1,4-distyrylbenezene.

(b) Azo Pigments

An azo pigment having the following general formula:

X—(N=N-Y)n where X represents a diazonium salt moiety, Y is a coupler moiety, and n is an integer of 1, 2 or 3.

(c) Phthalocyanine Pigments

Metal-free phthalocyanine, metal-free phthalocyanine derivatives, metal phthalocyanine and metal phthalocyanine derivatives can be employed.

It is preferable that the amount of the image gradation control agent be 0.5 to 10 parts by weight, more preferably 1 to 5 parts by weight, to 1 part by weight of the colorant in the image transfer layer.

Support Material

As the support material for use in the present invention, conventional films and papers employed in the field of thermosensitive recording can be used. More specifically, heat resistant plastic films made of polyester such as polyethylene terephthalate, polycarbonate, triacetyl cellulose, nylon or polyimide, cellophane, condenser paper and parchment paper are preferably employed as the support material. When a thermal head is employed as heat application device, it is preferable that the thickness of the support material 1 be about 2 to 15 μm. By contrast, when laser beams are employed as the heat application device, the thickness of the support material is not always restricted to the above mentioned range.

When a thermal head is employed, the heat resistance of the support material can be improved by coating the surface of the support material which comes into contact with the thermal head with a heat resistant protective layer comprising, for instance, silicone resin, fluorine-contained resin, polyimide resin, epoxy resin, phenolic resin, melamine resin or nitrocellulose.

Protective Layer

In the present invention, a protective layer can be formed on the back side of the support material opposite to the image transfer layer, which serves to protect the support material from the heat applied thereto during thermal recording and facilitate smooth movement of a thermal head on the support material, thereby obtaining image with excellent image gradation in a stable manner.

Such a protective layer can be made using as the main component a thermosetting, ultraviolet ray (UV) setting or electron beam (B) setting acrylic resin. Finely-divided inorganic or organic particles can be contained or dispersed in the protective layer.

The finely-divided organic or inorganic particles to be mixed with the above acrylic resins are not restricted to particles made of a particular material, but a variety of materials can be employed for such particles. For example, silica, alumina, titanium oxide, zinc oxide, calcium carbonate, aluminum carbonate, cobalt stearate, carbon fluoride, ethylene fluoride resin, polyimide resin and other hardened polymer beads can be employed.

It is preferable that the amount of the finely-divided particles be in the range of 0.1 to 100 parts by weight to 1 part by weight of the thermosetting acrylic resin.

With respect to the particle size of the finely-divided particles, the smaller, the better, since the smaller the particle size, the less the image quality is affected by the presence of the particles. Generally, it is preferable that the average particle size be 5 μm or less.

When forming a protective layer on the support material made of a polyester film, the above-mentioned thermosetting acrylic resins or a UV or EB setting acrylic resin, and the finely-divided particles are dispersed in a solvent, and the thus prepared dispersion is coated on the support material by use of a wire bar, air-knife, roll, or by gravure or by a screen coating process. It is preferable that the thickness of the coated protective layer be in the range of 0.1 to 8 μm, more preferably in the range of 0.5 to 3 um, in view of the necessary heat resistance and smoothness.

Intermediate Layer

In order to more firmly fix the above described porous network structure to the support material, thereby obtaining images with excellent image gradation, an intermediate layer may be interposed between the support material and the image transfer layer. Such intermediate layer can be made of a plastic resin or a filler-containing plastic resin.

In particular, for obtaining images with excellent image gradation, it is preferable to use a resin which is partly soluble in or compatible with the resin of which the porous network structure is composed.

Receiving Sheet

As the receiving sheet to be used in combination with the thermosensitive image transfer recording medium according to the present invention, conventional plain paper and synthetic paper can be employed. In order to facilitate the transfer of the coloring agent from the image transfer recording medium to the receiving sheet, it is preferable that a filler such as the above-mentioned resins, $TiO_2$, silica or ZnO be contained in such papers.

When thermal printing is performed by use of the thermosensitive image transfer recording medium according to the present invention, the recording medium is superimposed on the receiving sheet in such a manner that the image transfer layer comes into close contact with the receiving sheet, and heat is applied imagewise on the back side of the support material opposite to the image transfer layer by a heat application means such as a thermal head and a laser beam application device, thereby causing the thermofusible ink composition to melt and ooze from the porous network structure, and imagewise transferring the thermofusible ink composition onto the receiving sheet.

By referring to the following examples, the present invention will now be explained more specifically:

EXAMPLE 1

(1) Preparation of Thermosensitive Image Transfer Recording Medium No. 1

A mixtue of the following components was dispersed in a ball mill at 68° C. for about 48 hours:

| | Parts by Weight |
|---|---|
| Neozapon Blue 807 (Colorant) (made by BASF) | 10 |
| 2,7-bis [2-hydroxy-3-(2-chlorophenyl-carbamoyl)naphthalene-1-ylazo]-9-fluorenone (Gradation Control Agent) | 10 |
| Modified Lanolin Oil | 30 |
| Carnauba Wax | 20 |
| Paraffin Wax | 20 |
| Sorbon T-80 (Non-ionic surfactant, sorbitan monooleate, made by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 10 wt. % cellulose acetate butyrate solution comprising (i) a cellulose acetate butyrate with a butyryl group content of 17% (m.p. 230°~240° C.)(made by Kanto Chemical Co., Ltd.), (ii) toluene and (iii) methyl ethyl ketone, with the mixing ratio by weight thereof respectively being 10:20:20, were added. The mixture was dispersed for about 1 hour in a ball mill, so that an image transfer layer coating liquid was prepared.

The thus prepared image transfer layer coating liquid was coated by a wire bar on the front side of a polyester film having a thickness of 6 μm, backed with a silicone resin heat resistant layer, and was then dried at 100° C. for 1 minute, so that an image transfer layer having a thickness of about 5 μm was formed on the polyester film, whereby a thermosensitive image transfer recording medium No. 1 according to the present invention was prepared.

(2) Image Transfer Tests by Use of Thermosensitive Image Transfer Recording Medium No. 1

Image Transfer Recording Medium No. 1 was superimposed on a sheet of synthetic paper in such a manner that the image transfer layer came into close contact with the synthetic paper. A thermal head was then applied to the back side of the image transfer recording medium, with the applied thermal energy per dot varied o 0.5 mJ, 1.0 mJ, 1.5 mJ, 2.0 mJ and 2.5 mJ, so that the image densities of the respective images obtained were measured by a Macbeth densitometer. As a result, images with a cyan color having the image gradation as shown by Curve Ex. No. 1 in FIG. 1 was obtained.

(3) Heat Resistance and Light Resistance of the Image obtained by Thermosensitive Image Transfer Recording Medium No. 1

The image density of the cyan images recorded on the thermosensitive image transfer recording medium No. 1 was scarcely changed either when the recording medium was placed in an atmosphere at 60° C. for 50 hours by means of a thermostat or when the recording medium was exposed to light by a standard fade meter for 24 hours.

Comparative Example 1-1

Example 1 was repeated except that the cellulose acetate butyrate employed in Example 1 was replaced by a polyester resin (Vylon 200 made by Toyobo Co., Ltd.), whereby a comparative thermosensitive image transfer recording medium No. 1-1 was prepared.

Thermal printing was performed on this comparative thermosensitive image transfer recording medium in the same manner as in Example 1. The result was that a half-tone image was not obtained.

Comparative Example 1-2

Example 1 was repeated except that the cellulose acetate butyrate employed in Example 1 was replaced by a polycarbonate resin (G.E. LEXAN 141-111 made by Engineering Plastics, Ltd.), whereby a comparative thermosensitive image transfer recording medium No. 1-2 was prepared.

Thermal printing was performed on this comparative thermosensitive image transfer recording medium in the same manner as in Example 1. The result was that a half-tone image was not obtained.

Comparative Example 1-3

Example 1 was repeated except that the cellulose acetate butyrate employed in Example 1 was replaced by a styrene-acryl copolymer resin (RTR-28 made by Fujikura Kasei Co., Ltd.), whereby a comparative thermosensitive image transfer recording medium No. 1-3 was prepared.

Thermal printing was performed on this comparative thermosensitive image transfer recording medium in the same manner as in Example 1. The result was that a half-tone image was not obtained.

Comparative Example 1-4

Example 1 was repeated except that the cellulose acetate butyrate employed in Example 1 was replaced by a nitrocellulose resin ("DN type" made by Daicel Chemical Industries, Ltd.), whereby a comparative thermosensitive image transfer recording medium No. 1-4 was prepared.

Thermal printing was performed on this comparative thermosensitive image transfer recording medium in the same manner as in Example 1. As a result, an image with a cyan color having the image gradation as shown by Curve Comp. Ex. No. 1-4 in FIG. 1 was obtained.

Comparative Example 1-5

Example 1 was repeated except that the cellulose acetate butyrate employed in Example 1 was replaced by a vinyl chloride—vinyl acetate copolymer (VYHH made by Union Carbide Co., Ltd.), whereby a comparative thermosensitive image transfer recording medium No. 1-5 was prepared.

Thermal printing was performed on this comparative thermosensitive image transfer recording medium in the same manner as in Example 1. As a result, an image with a cyan color having the image gradation as shown by Curve Comp. Ex. No. 1-5 in FIG. 1 was obtained.

EXAMPLE 2

Example 1 was repeated except that the Neozapon Blue 807 (Colorant) employed in Example 1 was replaced by Spilon Red GRLT Special (made by Hodogaya Chemical Co., Ltd), whereby a thermosensitive image transfer recording medium No. 2 according to the present invention was prepared.

Thermal printing was performed on this thermosensitive image transfer recording medium in the same manner as in Example 1. As a result, a magenta image having the image gradation as shown by Curve Ex. No. 2 in FIG. 1 was obtained. This curve indicates that the image gradation was suitable for use in practice.

The image density of the cyan image recorded on the thermosensitive image transfer recording medium No. 2 was scarcely changed either when the recording medium was placed in an atmosphere at 60° C. for 50 hours or when the recording medium was exposed to light by a standard fade meter for 24 hours.

EXAMPLE 3

Example 1 was repeated except that the Neozapon Blue 807 (Colorant) employed in Example 1 was replaced by Neozapon Yellow R (made by BASF), whereby a thermosensitive image transfer recording medium No. 3 according to the present invention was prepared.

Thermal printing was performed on this thermosensitive image transfer recording medium in the same manner as in Example 1. As a result, a yellow image having the image gradation as shown by Curve Ex. No. 3 in FIG. 1 was obtained.

The image density of the yellow image recorded on the thermosensitive image transfer recording medium No. 3 was scarcely changed either when the recording medium was placed in an atmosphere at 60° C. for 50 hours or when the recording medium was exposed to light by a standard fade meter for 24 hours.

EXAMPLE 4

A mixture of the following components was dispersed in a ball mill at 68° C. for about 48 hours:

| | Parts by Weight |
|---|---|
| Neozapon Black RE (Colorant) (made by BASF) | 8 |
| Heltogen Blue D 7030 (Colorant) (made by BASF) | 15 |
| Machine Oil | 20 |
| Carnauba Wax | 20 |
| Castor Wax | 20 |
| Sorbon T-80 (Non-ionic surfactant, sorbitan monooleate, made by Toho Chemical Industry Co., Ltd.) (Dispersing Agent) | 0.4 |
| Liquid paraffin | 4 |
| Methyl ethyl ketone | 100 |
| Toluene | 130 |

To the above dispersion, 300 parts by weight of a 10 wt. % cellulose actate butyrate solution compriisng (i) a cellulose actate butyrate resin with a butyryl group content of 37%, (m.p. 155°~165° C.) (CAB-381-0.5 made by Eastman Kodak Company), (ii) toluene and (iii) methyl ethyl ketone, with the mixing ratio by weight thereof respectively being 10:20:20 were, added. The mixture was dispersed for about 1 hour in a ball mill, so that an image transfer layer coating liquid was prepared.

The thus prepared image transfer layer coating liquid was coated by a wire bar on the front side of a polyeseer film having a thickness of 6 μm, backed with a silicon. resin heat resistant layer, and was then dried at 100° C. for 1 minute, so that an image transfer layer having a thickness of about 4 μm was formed on the polyester film, whereby a thermosensitive image transfer recording medium No. 4 according to the present invention was prepared.

Thermal printing was performed on this thermosensitive image transfer recording medium in the same manner as in Example 1. As a result, a black image having the image gradation as shown by Curve Ex. No. 4 in FIG. 1 was obtained.

The image density of the black image recorded on the thermosensitive image transfer recording medium No. 4 was scarcely changed either when the recording medium was placed in an atmosphere at 60° C. for 50 hours or when the recording medium was exposed to light by a standard fade meter for 24 hours.

Example 5-1

A mixture of the following components was dispersed in a ball mill at 85° C. for about 24 hours:

| | Parts by Weight |
|---|---|
| Neozapon Blue 807 (Colorant) (made by BASF) | 3 |
| Lanolin Fatty Acid Oil (Neocoat OES-183 made by Yoshikawa Oil & Fat Co., Ltd.) (Oily Material) | 2.15 |
| Carnauba Wax (Carnauba Wax No. 1 made by Noda Wax Co., Ltd.) | 6 |
| Sorbon T-80 (Non-ionic surfactant, sorbitan monooleate, made by Toho Chemical Industry Co., Ltd.) (Dispersing Agent) | 0.12 |
| Liquid paraffin | 1.25 |
| Methyl ethyl ketone | 20 |
| Toluene | 50 |

To the above dispersion, 45 parts by weight of a 20 wt. % cellulose acetate butyrate solution comprising (i) the same cellulose acetate butyrate as that employed in Example 1, (ii) toluene and (iii) methyl ethyl ketone, with the mixing ratio by weight thereof respectively being 9:18:18, were added. The mixture was dispersed for about 1 hour in a ball mill, so that an image transfer layer coating liquid was prepared.

The thus prepared image transfer layer coating liquid was coated by a wire bar on the front side of a polyester film having a thickness of 6 μm, backed with a silicone resin heat resistant layer, and was then dried at 100° C. for 1 minute, so that an image transfer layer having a thickness of about 5 μm was formed on the polyester film, whereby a thermosensitive image transfer recording medium No. 5-1 according to the present invention was prepared.

In this thermosensitive image transfer recording medium, the content of the oily material in the image transfer layer is 10 wt. %.

Figure 2:
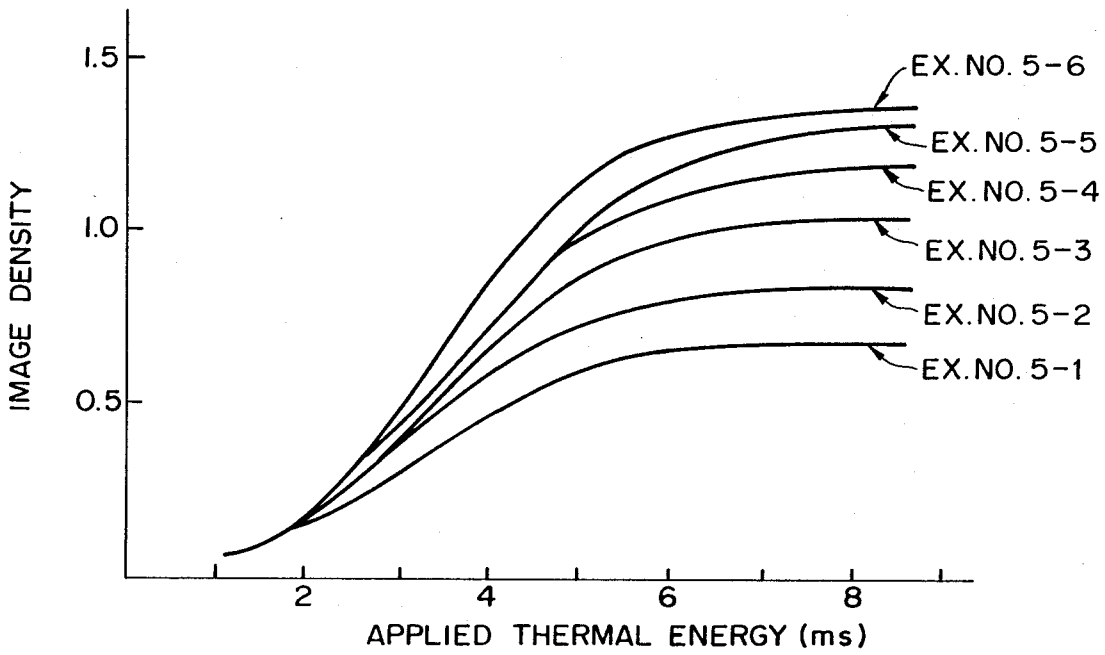

Image Transfer Recording Medium No. 5-1 was super-imposed on a sheet of plain paper having a smoothness of 37 seconds (Xerox Bond Paper 4024) in such a manner that the image transfer layer came into close contact with the paper. A thermal head was then applied to the back side of the image transfer recording medium, with the applied thermal energy per dot varied to 0.5 mJ, 1.0 mJ, 1.5 mJ, 2.0 mJ and 2.5 mJ, so that the image densities of the respective images obtained were measured by a Macbeth densitometer. As a result, images with a cyan color having the image gradation as shown by Curve Ex. No. 5-1 in FIG. 2 were obtained. The total quality obtained was fairly good since the background was clear, but there was room for improvement with respect to the uniformity of image quality, which is indicated by a mark "Δ" in Table 1.

Examples 5-2 to 5-6

Example 5-1 was repeated except that the amount of lanolin acid oil employed in Example 5-1 was increased as shown in Table 1, whereby thermosensitive image transfer recording mediums No. 5-2 to No. 5-6 according to the present invention were prepared.

Thermal printing was performed on these thermosensitive image transfer recording mediums in the same manner as in Example 5-1. As a result, images with a cyanine color having the image gradations as shown by Curves Ex. No. 5-2 to No. 5-6 in FIG. 2 were obtained.

In Table 1, in the uniformity of image quality, a mark "o" indicates that the uniformity of image quality was perfect, and a mark "Δ" indicates that the uniformity of image quality was fairly good, but there was still room for improvement thereof. In the background, a mark "o" indicates that the obtained background was clear, and a mark "Δ" indicates that the background was slightly unclear, but sufficiently suitable for use in practice.

TABLE 1

| | Examples | | | | | |
|---|---|---|---|---|---|---|
| | 5-1 | 5-2 | 5-3 | 5-4 | 5-5 | 5-6 |
| | Oily Material (wt. %) | | | | | |
| Formulation | 10% | 15% | 20% | 30% | 45% | 55% |
| Colorant (Neozapon Blue 807, made by BASF) | 3 | 3 | 3 | 3 | 3 | 3 |
| Lanolin Fatty Acid (Oily Material) (Neocoat OES-183, made by Yoshikawa Oil & Fat Co., Ltd.) | 2.15 | 3.4 | 4.8 | 8.3 | 15.8 | 23.7 |
| Carnauba Wax (Carnauba Wax No. 1, made by Noda Wax Co., Ltd.) | 6 | 6 | 6 | 6 | 6 | 6 |
| Dispersing Agent | 0.12 | 0.12 | 0.12 | 0.12 | 0.12 | 0.12 |
| Liquid Paraffin | 1.25 | 1.25 | 1.25 | 1.25 | 1.25 | 1.25 |
| Methyl ethyl ketone | 20 | 20 | 20 | 20 | 20 | 20 |
| Toluene | 50 | 50 | 50 | 50 | 50 | 50 |
| Uniformity of Image Quality | Δ | Δ | o | o | o | o |
| Background | o | o | o | o | o | Δ |

The image qualities obtained in Example 5-1 to 5-6 were fairly good and sufficiently suitable for use in practice. The above results indicate that when the content of the oily material was in the range of about 20 wt. % to about 50 wt. % in the image transfer layer, particularly high quality images can be obtained.

EXAMPLE 6-1

A mixture of the following components was dispersed in a ball mill at about 90° C. for about 48 hours:

| | Parts by Weight |
|---|---|
| Neozapon Blue 807 (Colorant) (made by BASF) | 10 |
| Oleinic Acid Ester Oil (Hisorate #117, Viscosity 80 cps/25° C.) (Oily Material with low viscosity) | 6.6 |
| Carnauba Wax (Carnauba Wax No. 1 made by Noda Wax Co., Ltd.) | 20 |
| Lanolin Fatty Acid Oil | 6 |

-continued

| | Parts by Weight |
|---|---|
| (Neocoat OES-183, made by Yoshikawa Oil & Fat Co., Ltd.) | |
| Sorbon T-80 (Non-ionic surfactant, sorbitan monooleate, made by Toho Chemical Industry Co., Ltd.) (Dispersing Agent) | 0.5 |
| Liquid paraffin | 3 |
| Methyl ethyl ketone | 60 |
| Toluene | 150 |

To the above dispersion, 300 parts by weight of a 20 wt. % cellulose acetate butyrate solution comprising (i) the same cellulose acetate butyrate as that employed in Example 1, (ii) toluene and (iii) methyl ethyl ketone, with the mixing ratio by weight thereof respectively being 20:40:40, were added. The mixture was dispersed for about 1 hour in a ball mill, so that an image transfer layer coating liquid was prepared.

The thus prepared image transfer layer coating liquid was coated by a wire bar on the front side of a polyester film having a thickness of 6 μm, backed with a silicone resin heat resistant layer, and was then dried at 100° C. for 1 minute, so that an image transfer layer having a thickness of about 5 μm was formed on the polyester film, whereby a thermosensitive image transfer recording medium No. 6-1 according to the present invention was prepared.

In this thermosensitive image transfer recording medium, the content of the oily material in the image transfer layer is 10 wt. %.

Figure 3:
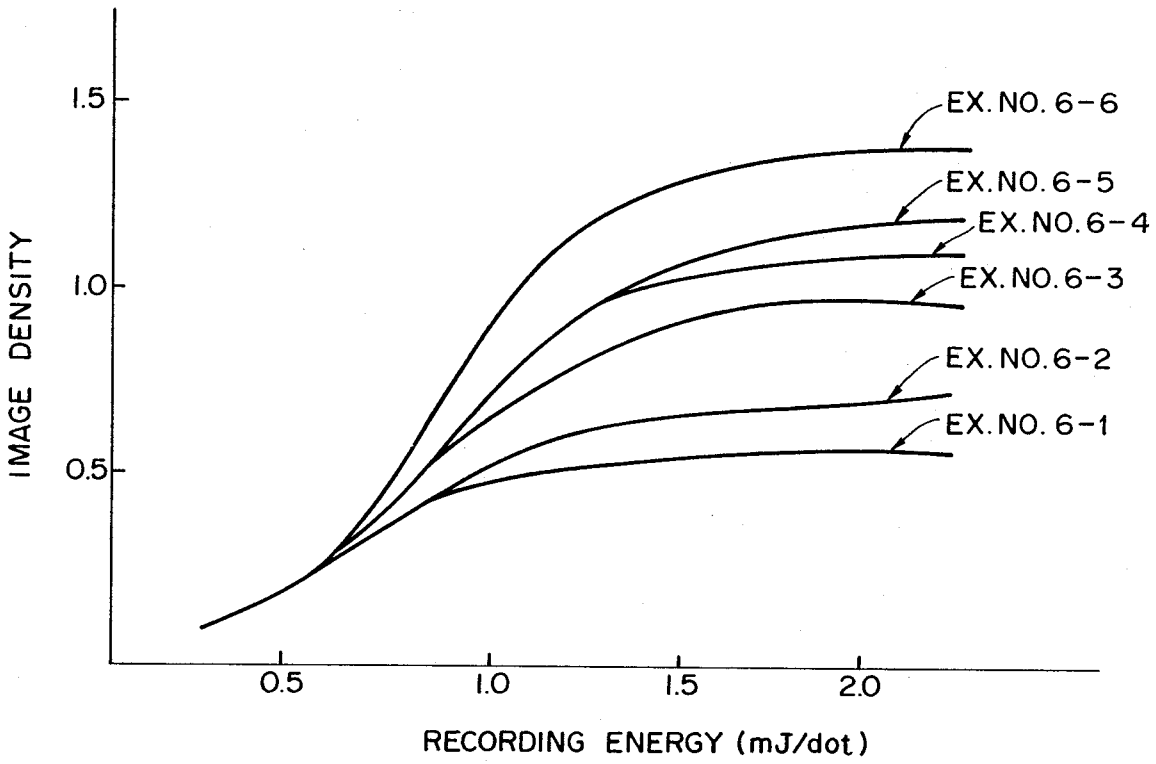

Image Transfer Recording Medium No. 6-1 was superimposed on a sheet of plain paper having a smoothness of 37 seconds (Xerox Bond Paper 4024) in such a manner that the image transfer layer came into close contact with the paper. A thermal head was then applied to the back side of the image transfer recording medium, with the applied thermal energy per dot varied to 0.5 mJ, 1.0 mJ, 1.5 mJ, and 2.0 mJ, so that the image densities of the respective images obtained were measured by a Macbeth densitometer. As a result, images with a cyan color having the image gradation as shown by Curve Ex. No. 6-1 in FIG. 3 were obtained.

Examples 6-2 to 6-6

Example 6-1 was repeated except that the amount of lanolin acid oil employed in Example 6-1 was increased as shown in Table 2, whereby thermosensitive image transfer recording mediums No. 6-2 to No. 6-6 according to the present invention were prepared.

Thermal printing was performed on these thermosensitive image transfer recording mediums in the same manner as in Example 6-1. As a result, images with a cyanine color having the image gradations as shown by Curves Ex. No. 6-2 to No. 6-6 in FIG. 3 were obtained.

In Table 1, in the uniformity of image quality, a mark "o" indicates that the uniformity of image quality was perfect, and a mark "Δ" indicates that the uniformity of image quality was fairly good, but there was still room for improvement thereof. In the background, a mark "o" indicates that the obtained background was clear, and a mark "Δ" indicates that the background was slightly unclear, but sufficiently suitable for use in practice.

TABLE 2

| Formulation | Examples 6-1 | 6-2 | 6-3 | 6-4 | 6-5 | 6-6 |
|---|---|---|---|---|---|---|
| | Oily Material (wt. %) | | | | | |
| | 10% | 15% | 20% | 30% | 50% | 60% |
| Colorant (Neozapon Blue 807, made by BASF) | 10 | 10 | 10 | 10 | 10 | 10 |
| Oleinic Acid Ester Oil (Hisorate #117, Viscosity 80 cps/25° C.) (Oily Material with low viscosity) | 6.6 | 10.5 | 14.9 | 25.5 | 59.5 | 89.3 |
| Lanolin Fatty Acid (Oily Material) (Neocoat OES-183, made by Yoshikawa Oil & Fat Co., Ltd.) | 6 | 6 | 6 | 6 | 6 | 6 |
| Carnauba Wax (Carnauba Wax No. 1, made by Noda Wax Co., Ltd.) | 20 | 20 | 20 | 20 | 20 | 20 |
| Dispersing Agent | 0.5 | 0.5 | 0.5 | 0.5 | 0.5 | 0.5 |
| Liquid Paraffin | 3 | 3 | 3 | 3 | 3 | 3 |
| Methyl ethyl ketone | 60 | 60 | 60 | 60 | 60 | 60 |
| Toluene | 150 | 150 | 150 | 150 | 150 | 150 |
| Uniformity of Image Quality | Δ | Δ | o | o | o | o |
| Background | o | o | o | o | o | Δ |

The image qualities obtained in Example 6-1 to 6-6 were fairly good and sufficiently suitable for use in practice. The above results indicate that when the content of the oily material was in the range of about 20 wt. % about 50 wt. % in the image transfer layer, particularly high quality images can be obtained.

EXAMPLE 7

Example 6-1 was repeated except that the oleinic acid ester oil employed in Example 6-1 was replaced by a 25.5 parts by weight of stearic acid ester oil (Hisorate #111, viscosity 36.8 cps/25° C.), whereby a thermosensitive image transfer recording mediums No. 7 according to the present invention was prepared.

In this thermosensitive image transfer recording medium, the amount of the oily material with low viscosity corresponds to 30 parts by weight of the entire weight of the thermosenstivie image transfer layer.

Thermal printing was performed on this thermosensitive image transfer recording medium in the same manner as in Example 6-1. The result was that the images obtained were as excellent as the images obtained in Example 6-4.

EXAMPLE 8

Example 6-1 was repeated except that the oleinic acid ester oil employed in Example 6-1 was replaced by a 25.5 parts by weight of capric acid ester oil (Hisorate #101, viscosity 22.2 cps/25° C.), and carnauba wax employed as thermofusible wax material in Example 6-1 was replaced by montan wax (made by Hoechst), whereby a thermosensitive image transfer recording mediums No. 8 according to the present invention was prepared.

In this thermosensitive image transfer recording medium, the amount of the oily material with low viscosity corresponds to 30 parts by weight of the entire weight of the thermosenstivie image transfer layer.

Thermal printing was performed on this thermosensitive image transfer recording medium in the same manner as in Example 6-1. The result was that the images obtained were as excellent as the images obtained in Example 6-4.

EXAMPLE 9

Example 6-1 was repeated except that the oleinic acid ester oil employed in Example 6-1 was replaced by a 25.5 parts by weight of peanut oil (Viscosity 150 cps/25° C.), whereby a thermosensitive image transfer recording mediums No. 9 according to the present invention was prepared.

In this thermosensitive image transfer recording medium, the amount of the oily material with low viscosity corresponds to 30 parts by weight of the entire weight of the thermosenstivie image transfer layer.

Thermal printing was performed on this thermosensitive image transfer recording medium in the same manner as in Example 6-1. The result was that the images obtained were as excellent as the images obtained in Example 6-4.

What is claimed is:

1. A thermosensitive image transfer recording medium, consisting essentially of:

a support material;

an image transfer layer of a finely porous network structure consisting of cellulose acetate butyrate formed on said support, said pores containing a material consisting essentially of:

(a-1) a non-volatile oil which does not dissolve the resin network structure, and (a-2) a thermofusible ink composition consisting essentially of (I) a thermofusible wax, which is solid at room temperature, selected from the group consisting of (i) an animal wax, (ii) montan wax, (iii) a wax selected from the group consisting of carnauba wax, paraffin wax, microcrystalline wax, castor wax, higher fatty acids, metal salts and esters of higher fatty acids and homopolymer or copolymer waxes, and (iv) mixtures thereof, and (ii) a colorant.

2. The thermosensitive image transfer recording medium as claimed in claim 1, wherein said cellulose actate butyrate has a butyryl content of 38% or less.

3. The thermosensitive image transfer recording medium as claimed in claim 1, wherein said non-volatile oil is contained in an amount ranging from about 20 to 50 wt. % in said image transfer layer.

4. The thermosensitive image transfer recording medium as claimed in claim 1, wherein said non-volatile oil has a viscosity of 300 cps or less at 25° C.

5. The thermosensitive image transfer recording medium as claimed in claim 1, wherein said non-volatile oil has a viscosity of 300 cps or less at 25° C. and is present in an amount ranging from about 20 to 50 wt. % in said image transfer layer.

6. The thermosensitive image transfer recording medium as claimed in claim 1, wherein said non-volatile oil is selected from the group consisting of cotton oil, rape oil, whale oil, motor oil, spindle oil, dynamo oil, lanolin fatty acid oil, lanolin fatty acid metal salt oil, and lanolin fatty acid ester oil.

7. The thermosensitive image transfer recording medium as claimed in claim 1, wherein said animal wax is a lanolin derivative wax.

8. The thermosensitive image transfer recording medium as claimed in claim 1, wherein said colorant is selected from the group consisting of direct dyes, acid dyes, basic dyes, mordant dyes, sulfur dyes, building dyes, azoic dyes, oil dyes and thermosublimable disperse dyes.

9. The thermosensitive image transfer recording medium as claimed in claim 1, wherein said colorant is a finely-divided pigment selected from the group consisting of:

Carbon black
Permanent Yellow GG 02 (C. I. Pigment Yellow 17)
Permanent Yellow DHG trans 02 (C. I. Pigment Yellow 12),
Novoperm Yellow HR 03 (C.I. Pigment Yellow 83),
Hansa Brilliant Yellow 5GX 02 (C.I. Pigment Yellow 74),
Permanent Orange RL 01 (C.I. Pigment Orange 34),
Novoperm Red HFG (C.I. Pigment Orange 38),
Novoperm Red HFT (C.I. Pigment Red 175),
Permanent Lake Red LCLL 02 (C.I. Pigment Red 53:1),
Novoperm Red HF 4B (C.I. Pigment Red 187),
Permanent Carmine FBB02 (C.I. Pigment Red 146),
Permanent Rubine L 6B (C.I. Pigment Red 57:1),
Hostaperm Pink E trans (C.I. Pigment Red 122), and
Reflex Blue Blue R50 (C.I. Pigment Blue 61).

10. The thermosensitive image transfer recording medium as claimed in claim 1, wherein said colorant is a finely-divided monoazo pigment having the formula:

$$X\text{-}N{=}N\text{-}Y$$

wherein X represents a diazonium salt moiety and Y represents a coupler moiety.

11. The thermosensitive image transfer recording medium as claimed in claim 1, wherein said support material is provided with a protective layer on the back side of said support material opposite to said image transfer layer, said protective layer comprising as the main component a resin selected from the group consisting of a thermosetting resin, a ultraviolet ray setting resin and an electron beam setting resin.

12. The thermosensitive image transfer recording medium as claimed in claim 1, further comprising an intermediate layer between said support material and said image transfer layer, said intermediate layer being made of a plastic resin which may contain a filter.

13. The thermosensitive image transfer recording medium as claimed in claim 1, wherein said image transfer layer further comprises an image gradation control agent is selected from the group consisting of a needle-like pigment, an azo pigment, and a phthalocyanine pigment.

14. The thermosensitive image transfer recording medium as claimed in claim 13, wherein the amount of said image gradation control agent is in the range of 1 to 5 parts by weight to 1 part by weight of said colorant in said image transfer layer.

15. The thermosensitive image transfer recording medium as claimed in claim 1, wherein said fatty acid, fatty acid metal salt or fatty acid ester is stearic acid, palmitic acid, aluric acid, aluminum stearate, lead stearate, barium stearate, zinc stearate, zinc palmitate, methylhydroxy stearate or glycerol monohydroxy stearate.

16. The thermosensitive image transfer recording medium as claimed in claim 1, wherein said homopolymer or copolymer wax is polyethylene, polypropylene, polyisobutylene, polyethylene oxide, polytetrafluoroethylene, ethylene-acrylic acid copolymer, ethylene-ethyl acrylate copolymer, or ethylene-vinyl acetate copolymer.

* * * * *